US011803145B2

(12) United States Patent
Tomiyori

(10) Patent No.: US 11,803,145 B2
(45) **Date of Patent: *Oct. 31, 2023**

(54) SHEET HEATING DEVICE AND IMAGE FORMING APPARATUS

(71) Applicant: SHARP KABUSHIKI KAISHA, Osaka (JP)

(72) Inventor: Minoru Tomiyori, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/944,800

(22) Filed: Sep. 14, 2022

(65) Prior Publication Data

US 2023/0019251 A1 Jan. 19, 2023

Related U.S. Application Data

(62) Division of application No. 17/511,556, filed on Oct. 27, 2021, now Pat. No. 11,480,902.

(30) Foreign Application Priority Data

Oct. 27, 2020 (JP) ..... 2020-179905

(51) Int. Cl.
*G03G 15/20* (2006.01)

(52) U.S. Cl.
CPC ..... *G03G 15/2053* (2013.01); *G03G 15/2064* (2013.01); *G03G 15/2042* (2013.01)

(58) Field of Classification Search
CPC ..... G03G 15/2042; G03G 15/2046; G03G 15/205; G03G 15/2053
See application file for complete search history.

(56) References Cited

U.S. PATENT DOCUMENTS

2004/0001733 A1* 1/2004 Richtsmeier ..... G03G 15/657 399/397
2009/0016764 A1 1/2009 Kitozaki
2013/0108299 A1 5/2013 Minagawa et al.
2015/0268606 A1* 9/2015 Hayase ..... G03G 15/2053 399/330
2016/0216664 A1 7/2016 Yagi et al.
2016/0223963 A1 8/2016 Yoshinaga et al.
2016/0357144 A1 12/2016 Saito et al.
(Continued)

FOREIGN PATENT DOCUMENTS

CN 110083037 A 8/2019
JP H02-109373 U 8/1990
(Continued)

OTHER PUBLICATIONS

Notice of Allowance of U.S. Appl. No. 17/511,556 dated Jun. 16, 2022.

*Primary Examiner* — Sevan A Aydin
(74) *Attorney, Agent, or Firm* — ScienBiziP, P.C.

(57) ABSTRACT

A sheet heating device includes: a heat roller including a lamp heater; a fixing frame supporting end parts of the heat roller and the lamp heater; and a heat-insulating cover member provided outside of the fixing frame. The fixing frame is disposed so as to cover the space above the heat roller. A plurality of heat retention spaces is provided inside of the cover member so as to be partitioned from one another and to be opened toward the fixing frame.

14 Claims, 14 Drawing Sheets

(56) References Cited

U.S. PATENT DOCUMENTS

| | | | |
|---|---|---|---|
| 2018/0120740 | A1 | 5/2018 | Ukai |
| 2019/0354047 | A1 | 11/2019 | Uchiyama |
| 2020/0301331 | A1 | 9/2020 | Mitsuoka |
| 2020/0319544 | A1 | 10/2020 | Struble et al. |

FOREIGN PATENT DOCUMENTS

| | | | |
|---|---|---|---|
| JP | 2021508916 | A | 3/2021 |
| KR | 100301566 | B1 | 10/2001 |

* cited by examiner

SHEET HEATING DEVICE AND IMAGE FORMING APPARATUS

CROSS-REFERENCE TO RELATED APPLICATIONS

This application is a divisional application of U.S. patent application Ser. No. 17/511,556, filed on Oct. 27, 2021, which claims priority under 35 U.S.C. § 119 (a) on Patent Application No. 2020-179905 filed on Japan on Oct. 27, 2020, the entire contents of which are herein incorporated by reference.

DESCRIPTION OF THE BACKGROUND ART

Image forming apparatuses that include a fixing device using a heat roller fixing method are well known as the image forming apparatuses (e.g. a copier and a printer) that form an image on a sheet by an electrographic image forming method. The fixing device using the heat roller fixing method includes a heat roller and a pressure roller that is pressed against the heat roller, and such a pair of rollers is heated to a predetermined fixing temperature by a heat source such as a halogen heater installed in both or either one of the heat roller and the pressure roller. Then, the sheet on which an unfixed toner image is formed is passed through a fixing nip portion formed by a part where the heat roller and the pressure roller are pressed against each other. Thus, toner powders forming the unfixed toner image are heated and melted by heat and pressure, so that the unfixed toner image is fixed onto the sheet.

In these kinds of image forming apparatuses, the heat source is controlled to be turned on every time when the image forming processing is performed, and turned off when the image forming processing is completed. Therefore, when the next image forming processing is performed, it takes some time to re-heat the pair of rollers to the predetermined fixing temperature. Thus, it is likely to take a relatively long warm-up time.

In order to respond to the above problem, for example, Japanese Unexamined Utility Model Application Publication No. H02-109373 discloses a configuration in which an insulation cover is provided above the fixing device and one end part of a heat lamp installed in the heat roller is held using a plastic cap while the other end part is fixed by a cover member so as to insulate the end parts of the heat lamp.

However, since the insulation cover is not sufficient to retain the heat, the fixing device is further covered by the cover member. As a result, the number of components increases, which leads to increase in device size and costs. Also, since there are a number of components, attachment/detachment works may be difficult.

Recently, there has been a need for further energy saving performance, and thus, it seems more and more necessary to reduce power consumption for re-heating by preventing heat outflow to the outside of the device and heat loss in the device. In consideration of these circumstances, the above-described configuration disclosed in Japanese Unexamined Utility Model Application Publication No. H02-109373 cannot exert a sufficient heat retaining effect, which may results in a relatively long warm-up time.

SUMMARY OF THE INVENTION

The present invention was made in consideration of the above problems, an object of which is to provide a sheet heating device and an image forming apparatus including the sheet heating device. The sheet heating device of the present invention has excellent maintainability with easy attachment/detachment works and has a simple structure with a few components to exert a heat retaining effect and thus to improve heating efficiency.

In order to achieve the above object, a sheet heating device of the present invention includes: a heat source including a heat generating part and support parts respectively provided at both end parts of the heat generating part; a cylinder-shaped heating member provided with the heat generating part disposed inside thereof and the support parts disposed outside thereof; a frame including side parts disposed so as to face each other and a connecting part connecting the side parts, the frame supporting the heating member and the heat source; and a heat-insulating cover member detachably engaged with the frame and provided outside of the frame. The connecting part of the frame is disposed so as to cover a space above the heating member. A plurality of heat retention spaces is provided inside of the cover member so as to be partitioned from one another and to be opened toward the connecting part.

In the sheet heating device having the configuration as described above, it is preferable that the plurality of heat retention spaces includes: first spaces respectively provided above the support parts; and at least one second space provided above the connecting part. Also, it is preferable that the first spaces and the at least one second space are separated from one another. With this configuration, it is possible to retain the heat in the first spaces and the second space formed above the heat source that is provided in the heating member. Accordingly, it is possible to prevent the heat outflow to the outside of the device and the heat loss in the device.

Also, an image forming apparatus including the sheet heating device having the above-described configuration is also within the scope of the technical idea of the present invention. In this way, it is possible to obtain high heat retaining effect around the heating member, which contributes to reduction in power consumption for re-heating. Therefore, it is possible to provide further improved energy serving performance in the image forming apparatus.

With the present invention, it is possible to provide, to an image forming apparatus, the sheet heating device that has excellent maintainability with easy attachment/detachment works. Thus, it is possible to obtain an excellent heat retaining effect and thus to improve heating efficiency.

DESCRIPTION OF THE PREFERRED EMBODIMENTS

Hereinafter, s sheet heating device 10 and an image forming apparatus 1 according to an embodiment of the present invention will be described with reference to the drawings.

(General Configuration of Image Forming Apparatus)

Figure 1:
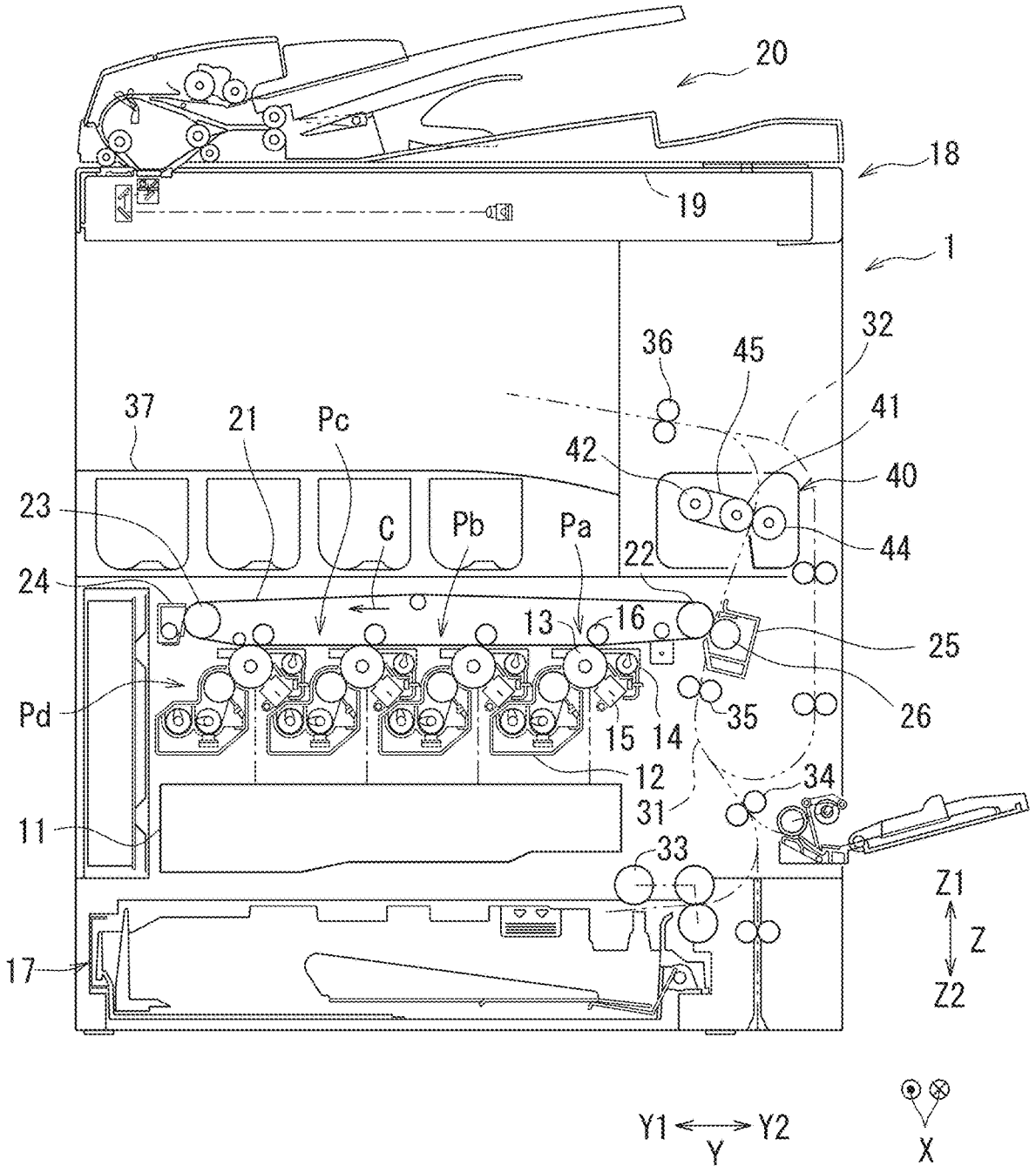
FIG. 1 is a cross-sectional view illustrating a schematic configuration of an image forming apparatus according to an embodiment of the present invention.

FIG. 1 is a cross-sectional view illustrating a schematic configuration of the image forming apparatus 1 according to the embodiment of the present invention.

The image forming apparatus 1 is a multifunction peripheral functioning as a scanner, a copier, a printer, a facsimile machine and the like. The image forming apparatus 1 sends an image of an original sheet read by an image reading device to an external device (corresponding to a function as a scanner), and forms a multicolor or monochrome image of the read original or an image received from an external device on a sheet (corresponding to functions as a copier, a printer and a facsimile machine).

On an image reading device 18, an original sheet transport unit (automatic document feeder, "ADF") 20 is provided and supported so as to be freely opened and closed with respect to the image reading device 18. The original sheet transport unit 20 can be opened to expose a platen glass 19 of the image reading device 18 so that an original sheet can be manually placed thereon. Also, the original sheet transport unit 20 automatically transports an original sheet that is placed thereon. The image reading device 18 reads the manually placed original sheet or the original sheet transported by the original sheet transport unit 20, and generates image data.

The image forming apparatus 1 includes: an optical scanning device 11; a developing device 12; a photosensitive drum 13; a drum cleaner 14; a charger 15; an intermediate transfer belt 21; a fixing device 40; a sheet transport path 31; a sheet feed unit 17; and a discharge tray 37.

Image data handled by the image forming apparatus 1 corresponds to a color image using respective colors of black (K), cyan (C), magenta (M), and yellow (Y), or corresponds to a monochrome image using a single color (for example, black). In order to form four kinds of toner images, the image forming apparatus 1 includes the following components: four developing devices 12, four photosensitive drums 13, four drum cleaners 14 and four chargers 15. Each of the four components corresponds to black, cyan, magenta, and yellow. Thus, four image stations Pa, Pb, Pc, and Pd are constituted.

The drum cleaner 14 removes and collects residual toner on the surface of the photosensitive drum 13. The charger 15 uniformly charges the surface of the photosensitive drum 13 at a predetermined electric potential. The optical scanning device 11 exposes the surface of the photosensitive drum 13 to form an electrostatic latent image on the surface thereof. The developing device 12 develops the electrostatic latent image on the surface of the photosensitive drum 13 so as to form a toner image on the surface of the photosensitive drum 13. By the above series of operations, the toner images in respective colors are formed on the surfaces of the respective photosensitive drums 13.

On the photosensitive drum 13, an intermediate transfer roller 16 is provided with the intermediate transfer belt 21 being interposed therebetween. The intermediate transfer belt 21 is an image carrier on which the toner image is formed, and stretched to be laid between a transfer drive roller 22 and a transfer driven roller 23 so as to be rotated (moved circularly) in the direction indicated by the arrow C. The toner images in the respective colors formed on the surfaces of the photosensitive drums 13 are sequentially transferred (primary transferring processing) and superimposed on one after another, thus a multicolor toner image is formed on the surface of the intermediate transfer belt 21.

A nip region (secondary transferring position) is formed between a transfer roller 26 of a secondary transfer unit 25 and the intermediate transfer belt 21. The sheet, which has been transported via the sheet transport path 31, is further transported with being sandwiched in the nip region. When the sheet passes through the nip region, the toner image on the surface of the intermediate transfer belt 21 is transferred on the sheet, and the sheet is transported to the fixing device 40. The remaining toner on the intermediate transfer belt 21 is collected by a belt cleaner 24.

A fixing belt 45 (see FIG. 2 explained later) is disposed to be wrapped around a fixing roller 41 and a heat roller 42. The fixing device 40 receives the sheet on which an unfixed toner image is formed, and transports the sheet in a state being sandwiched between the fixing belt 45 and a pressure roller 44.

The sheet feed unit 17, which stores sheets on which an image is to be formed, is provided under the optical scanning device 11. The sheet is drawn from the sheet feed unit 17 by a sheet pickup roller 33 and transported via the sheet transport path 31 so as to pass through the transfer roller 26, the fixing roller 41 and the like. Then, the sheet is discharged to the discharge tray 37 via discharge rollers 36. The sheet transport path 31 is provided with sheet registration rollers 35, transport rollers 34 and the discharge rollers 36. The sheet registration rollers 35 temporarily stop the sheet so as to arrange the leading edge thereof, and start to transport the sheet at a timing when the color toner image is transferred in the nip region between the intermediate transfer belt 21 and the transfer roller 26. The transport rollers 34 allow the sheet to be smoothly transported.

When the image is formed not only on the front surface of the sheet but also on the back surface of the sheet, the sheet is transported from the discharge rollers 36 to a reverse sheet path 32 in the reverse direction so that the front and the back of the sheet are reversed. Then, the sheet is guided again to the sheet registration rollers 35 so as to form an image on the back surface thereof as in the case of the front surface. After that, the sheet is transported to the discharge tray 37.

(Sheet Heating Device)

Next, the sheet heating device 10 provided in the image forming apparatus 1 is described.

Figure 2:
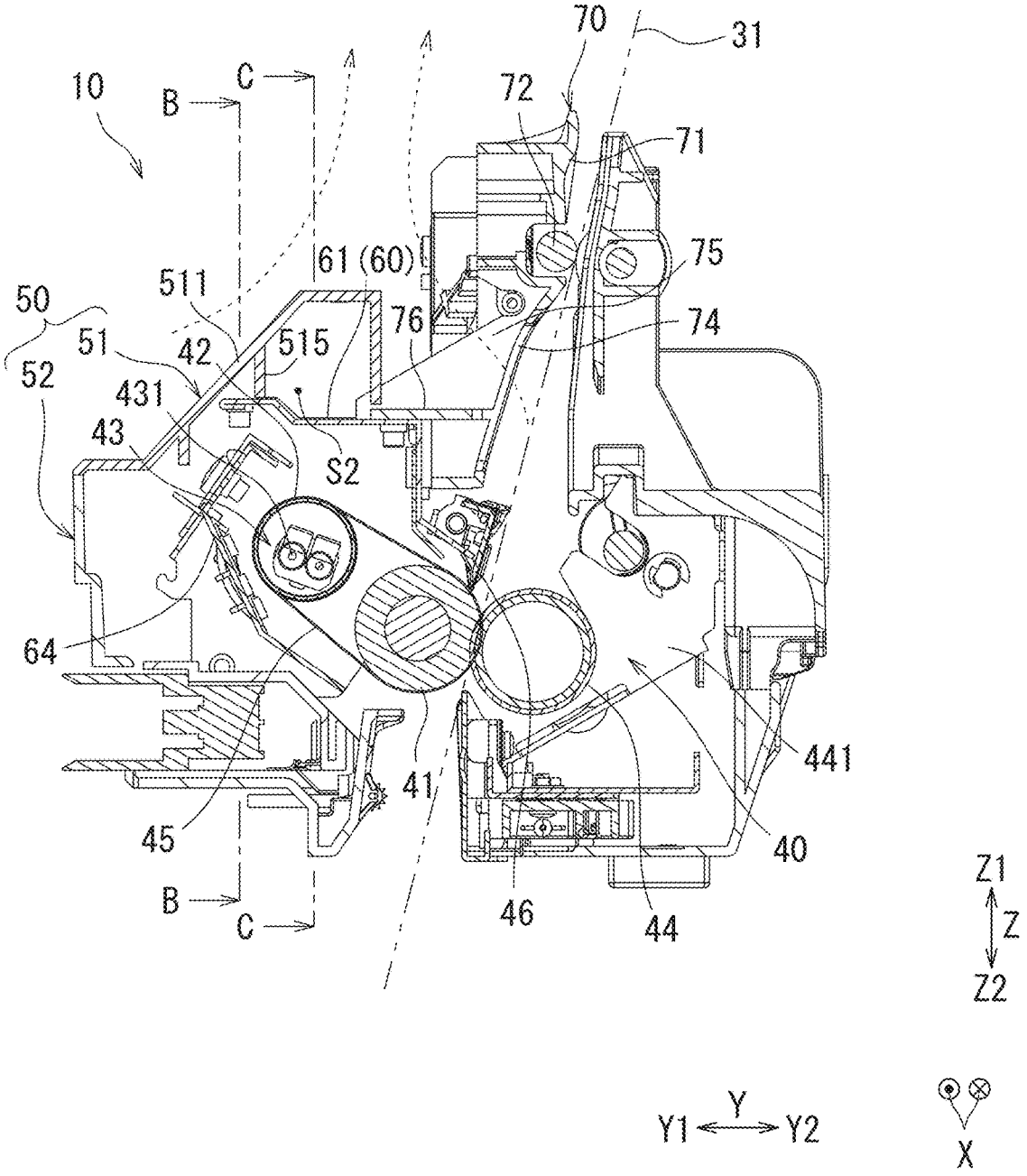
FIG. 2 is a cross-sectional view illustrating a sheet heating device and a sheet transport path of the image forming apparatus.
Figure 3:
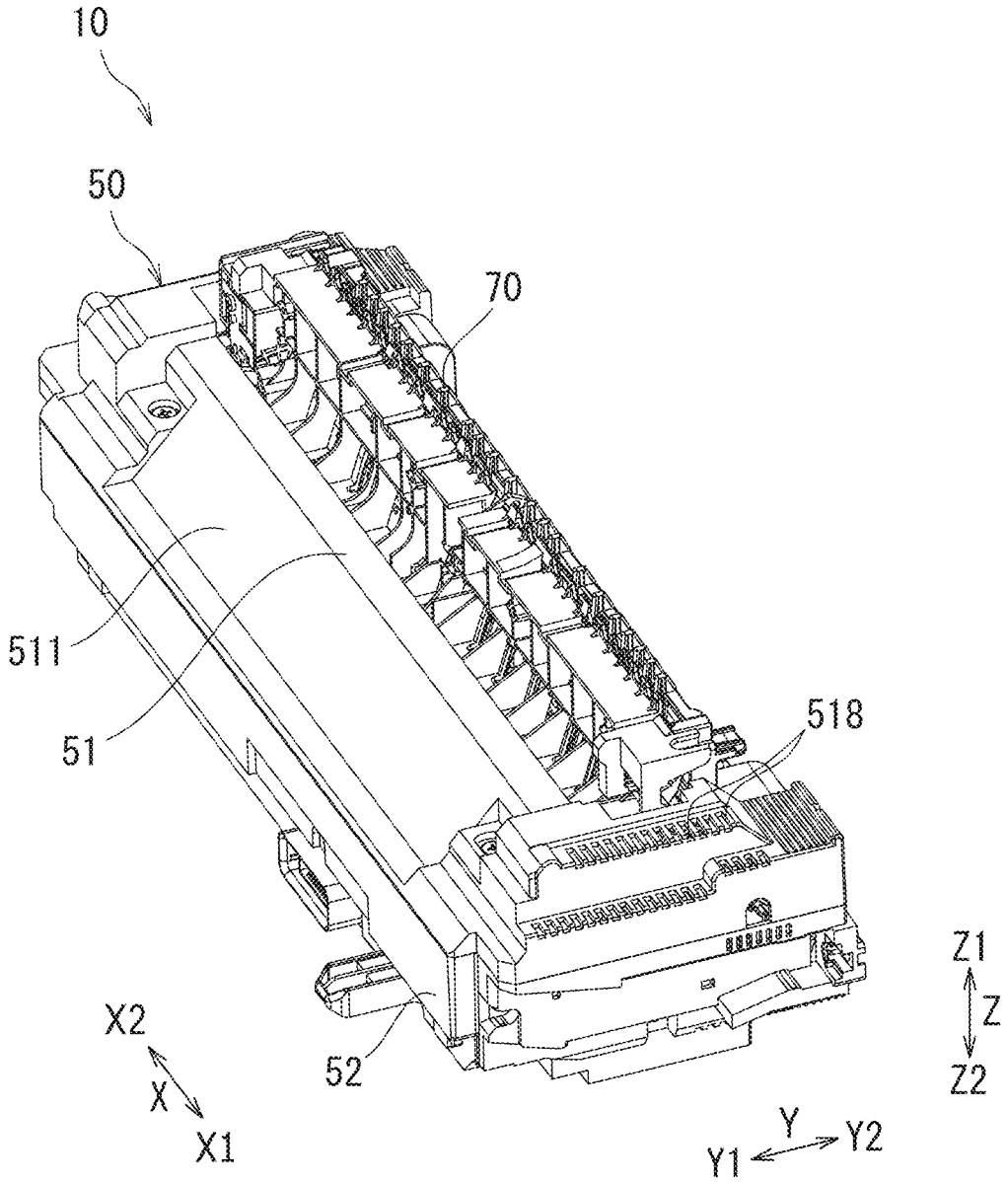
FIG. 3 is a perspective view illustrating the sheet heating device.

FIG. 2 is a cross-sectional view illustrating the sheet heating device 10 according to this embodiment. FIG. 3 is a perspective view illustrating the sheet heating device 10. For the sake of explanation, a direction along a rotation axis of the fixing roller 41 in the drawings is defined as the axial direction X. Also as shown in FIG. 1, when the image forming apparatus 1 is viewed from the front side, a direction intersecting with the axial direction X in the left and right direction is defined as the horizontal direction Y (width direction), and furthermore the left side is defined as Y1 and the right side is defined as Y2. Also, a direction intersecting with the axial direction X in the height direction is defined as the vertical direction Z, and furthermore the upper side is defined as Z1 and the lower side is defined as Z2. However, these definitions do not at all limit the use direction of the image forming apparatus 1.

The sheet heating device 10 is provided along the sheet transport path 31 of the image forming apparatus 1 so as to be incorporated around the heat roller (heating member) 42 of the fixing device 40 so that the heat roller 42 is the center thereof. As shown in FIG. 2, the sheet heating device 10 includes the fixing roller 41, the heat roller 42, the pressure roller 44, and the fixing belt 45 of the fixing device 40. The sheet heating device 10 is to reduce heat outflow to the outside of the device and also to reduce heat loss in the device by providing a plurality of partitioned heat retention spaces between a fixing frame 60 covering above the heat roller 42 and a cover member 50 outside of the fixing frame 60.

The fixing belt 45 is wrapped around the heat roller 42 and the fixing roller 41. Via the fixing belt 45, the heat of the heat roller 42 is transmitted to the sheet, and the sheet is sandwiched between the fixing roller 41 and the pressure roller 44 pressed against the fixing roller 41 so that the toner image formed on the sheet is fixed. The fixing roller 41 is, for example, a columnar roller connected to a drive unit (not shown). The fixing roller 41 is constituted of a core metal made of stainless steel and an elastic layer surrounding the core metal. The elastic layer is made of a heat-resistant elastic member such as silicone sponge rubber.

The heat roller 42 is a cylinder-shaped heating member that includes a heat source. The heat source is, for example, a lamp heater 43 such as a halogen lamp. The lamp heater 43 includes a heat generating part 431 and support parts 432 respectively provided at both end parts of the heat generating part 431.

The heat generating part 431 of the lamp heater 43 is disposed inside of the heat roller 42, and the support parts 432 of the lamp heater 43 are respectively disposed so as to be exposed to the outside from both end parts of the heat roller 42. In other words, the heat roller 42 is provided with the heat generating part 431 on the inside thereof, and the respective support parts 432 on the outside thereof. With this configuration, the heat roller 42 is totally heated from the inside by radiant heat of the heat generating part 431. In order to absorb the radiant heat, a heat absorbing layer may be provided on the inner surface of the heat roller 42.

The pressure roller 44 includes: a core metal made of, for example, ferroalloy (STKM); an elastic layer made of silicone solid rubber, which surrounds the core metal; and a releasing layer made of PFA tube, which surrounds the elastic layer. The pressure roller 44 is disposed at a position facing the fixing roller 41 with the fixing belt 45 being interposed therebetween.

The fixing belt 45 is an endless belt and made by, for example, the following materials layered from the inside in this order: a base material made of polyimide; an elastic layer made of silicone rubber; and a releasing layer made of PFA tube. The fixing belt 45 is moved circularly.

The fixing roller 41, the heat roller 42 and the pressure roller 44 are arranged such that their rotation axes are along the axial direction X. The belt-width direction of the fixing belt 45 is along the axial direction X. The axial direction X corresponds to the front-back direction of the image forming apparatus 1 when viewed from the front of the apparatus, as shown in FIG. 1.

As shown in FIG. 2, a peeling member 46 is disposed in the vicinity of the fixing roller 41 so as to be along the axial direction X of the rotation axis of the fixing roller 41. The peeling member 46 is to peel the sheet from the fixing belt 45 with which the sheet is coming into contact. The sheet heating device 10 is also provided with a sheet transport guide 70 that guides the sheet on which the image is fixed from the fixing roller 41 in the transport direction of the guide roller 72. The sheet transport guide 70 is disposed downstream of the fixing nip portion between the fixing roller 41 and the pressure roller 44 in the sheet transport direction.

In this embodiment, the sheet transport guide 70 includes a sheet guide part 71 extending along the sheet transport path 31 and a plurality of vents 74 penetrating the sheet guide part 71. The sheet transport guide 70 functions to guide the sheet transported after fixation of the toner image downstream in the transport direction while supporting the sheet by the sheet guide part 71. On the downstream side of the sheet guide part 71 in the transport direction, a rotatable guide roller 72 is provided so as to smoothly transport the sheet.

Also, the sheet guide part 71 is provided with a plurality of guide ribs 73 on its surface (see FIG. 6) so as to reduce the contact area between the sheet transport guide 70 and the sheet and thus to reduce the sliding resistance. The sheet transport guide 70 can transport the sheet along the sheet guide part 71 while circulating air through the vents 74.

The sheet heating device 10 according to this embodiment further includes: a fixing frame (frame) 60 that supports the heat roller 42 and the lamp heater 43; and a cover member 50 that covers the outside of the fixing frame 60.

Figure 4:
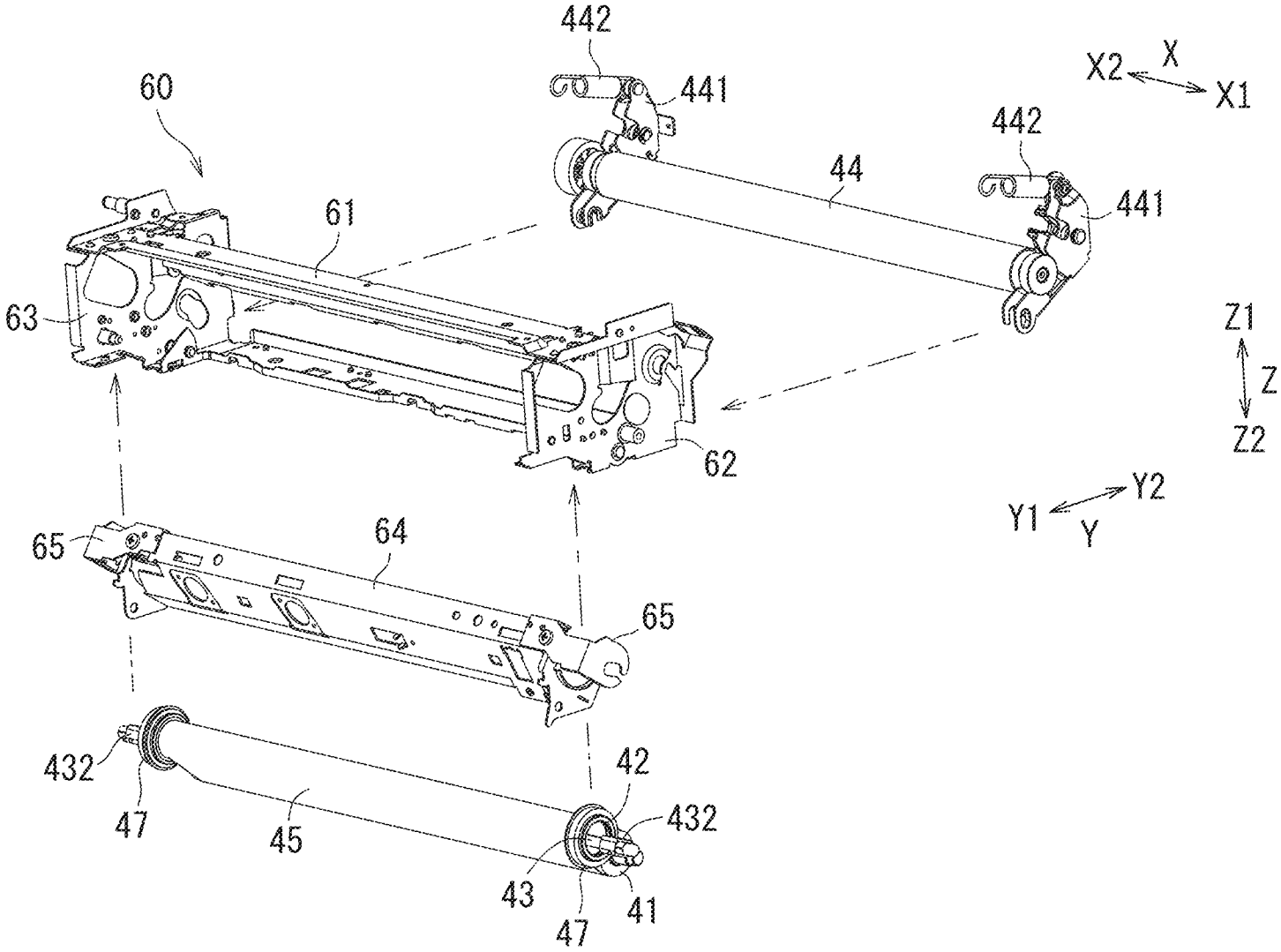
FIG. 4 is an explanatory diagram indicating an attaching structure of a fixing frame in the sheet heating device.
Figure 5:
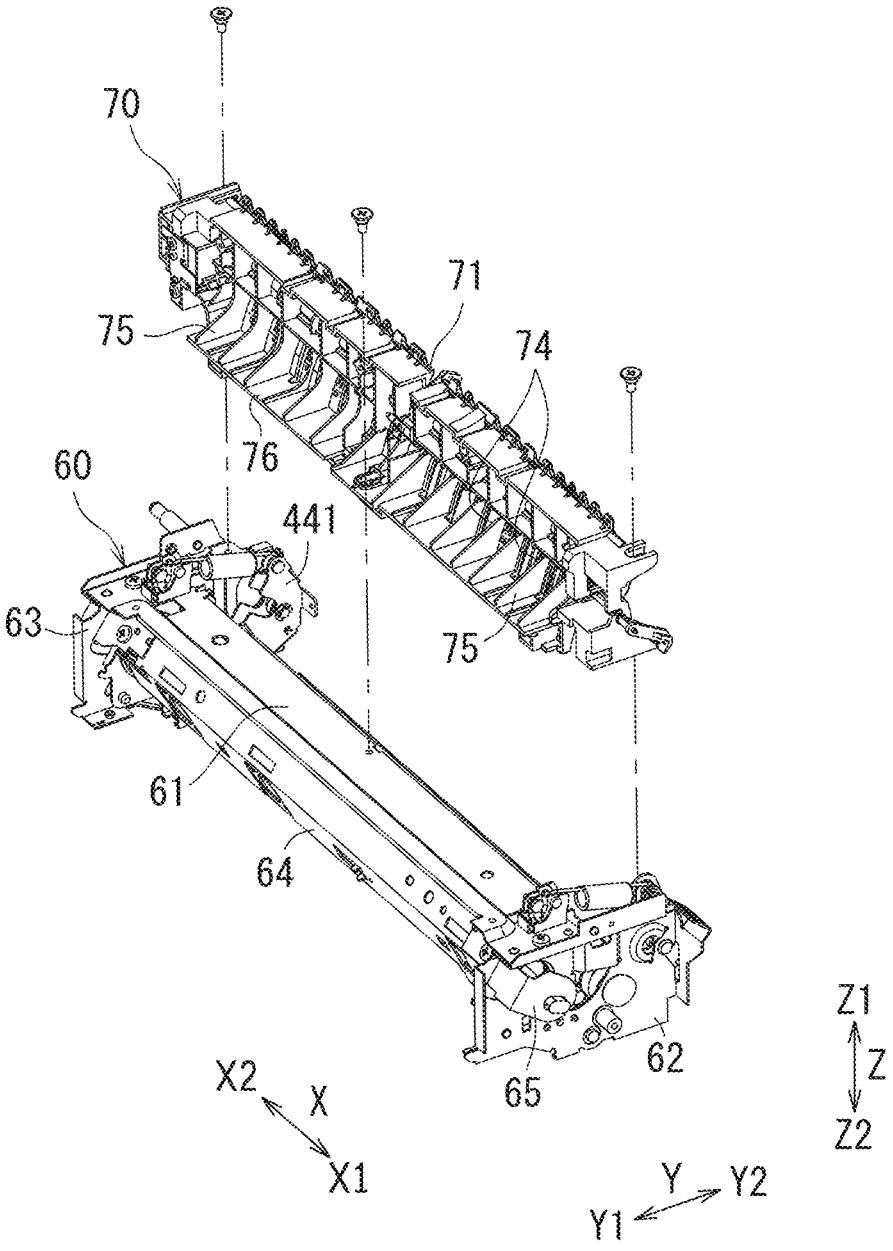
FIG. 5 is an explanatory diagram indicating an attaching structure of the fixing frame to a sheet transport guide.
Figure 6:
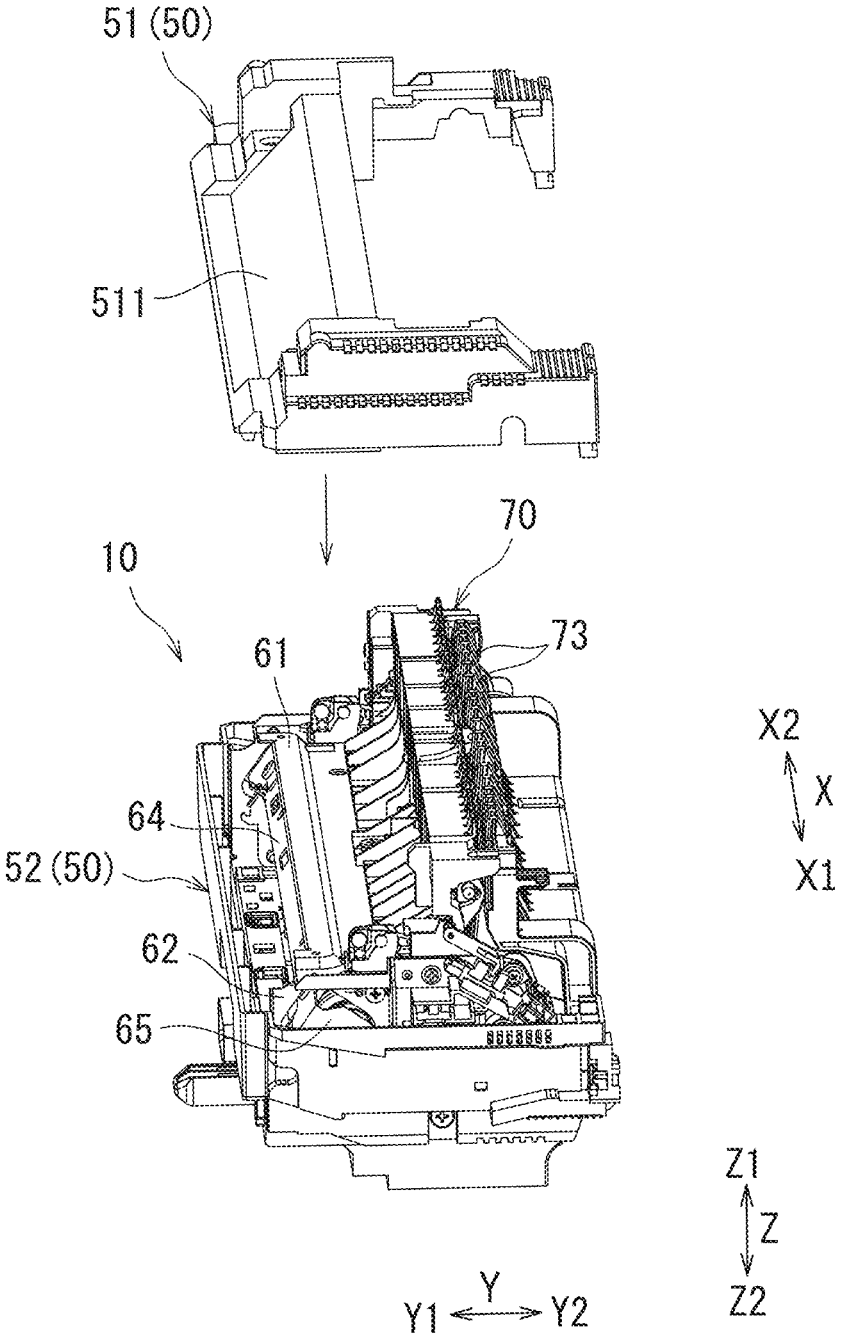
FIG. 6 is an explanatory diagram indicating an attaching structure of a cover member to the sheet heating device.
Figure 7:
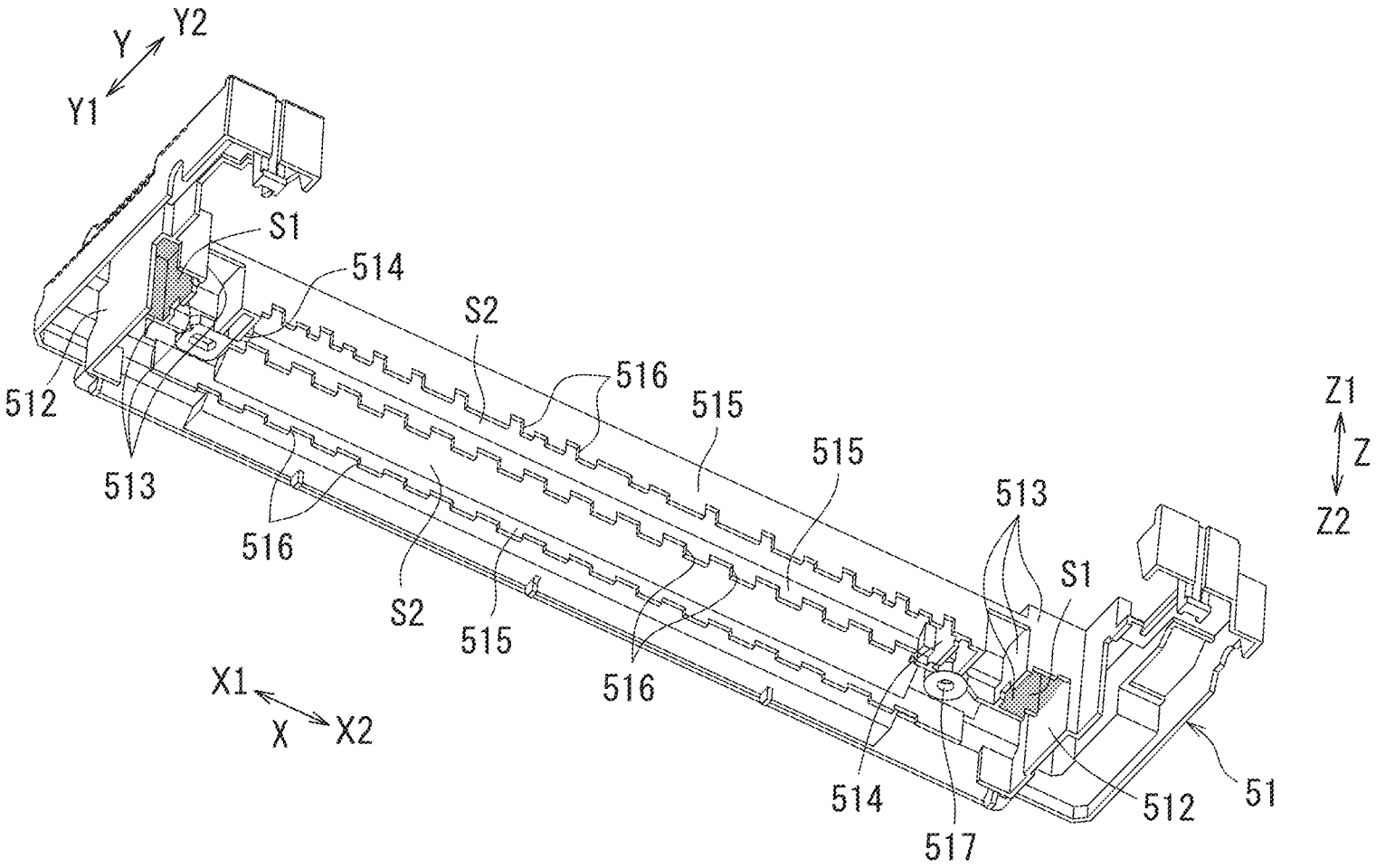
FIG. 7 is a perspective view illustrating an inside of the cover member viewed from below.

FIG. 4 is an explanatory diagram indicating an attaching structure of the fixing frame 60 in the sheet heating device 10. FIG. 5 is an explanatory diagram indicating an attaching structure of the fixing frame 60 to the sheet transport guide 70. FIG. 6 is an explanatory diagram indicating an attaching structure of the cover member 50. FIG. 7 is a perspective view illustrating an inside of the cover member 50 viewed from below.

As shown in FIG. 4, the fixing frame 60 includes: a front frame (side part) 62 provided on the front side X1 in the axial direction X; a rear frame (side part) 63 provided on the back side X2 in the axial direction X so as to face the front frame 62; and a top board frame (connecting part) 61 connected to respective upper edge parts of the front frame 62 and the rear frame 63. The front frame 62 and the rear frame 63 support respectively both end parts of the heat roller frame 64 via which the heat roller 42 and the lamp heater 43 are further supported.

As shown in FIG. 5, the front frame 62 and the rear frame 63 of the fixing frame 60 rotatably support and position both end parts of the heat roller 42 and both end parts of the fixing roller 41. More specifically, as shown in FIG. 4, the heat roller 42 is pivotably supported by the heat roller frame 64 via bearings 47. The support parts 432 of the lamp heater 43, which protrude from both end parts of the heat roller 42, are supported by both end parts of the heat roller frame 64 via lamp holders 65.

The heat roller frame 64, which supports the heat roller 42 and the lamp heater 43, is attached to the front frame 62 and the rear frame 63 via attachment parts (not shown). When the heat roller frame 64 is attached to the front frame 62 and the rear frame 63, one lamp holder 65 is positioned in front of the front frame 62 on the front side X1 in the axial direction X while the other lamp holder 65 is positioned behind the rear frame 63 on the back side X2 in the axial direction X. The heat roller frame 64 includes a thermistor or the like that is disposed facing the surface of the fixing belt 45 so as to detect the surface temperature of the fixing belt 45.

As shown in FIG. 4, the pressure roller 44 is attached to the fixing frame 60 via pressure levers 441. Both end parts of the pressure roller 44 are pivotably supported by the pressure levers 441. One end part of each pressure lever 441 is pivotably supported by the fixing frame 60 while the other end part thereof is connected to the fixing frame 60 via a biasing member 442. The pressure roller 44 is supported so as to be biased toward the fixing roller 41 and thus pressed against the fixing roller 41.

As shown in FIG. 5, the sheet transport guide 70 is further attached to the fixing frame 60. The sheet transport guide 70 is provided with a plate-shaped attachment part 76 extended in the direction intersecting with the sheet guide part 71. The attachment part 76 has fastening parts so that the sheet transport guide 70 is fixed to the top board frame 61 using fasteners such as screws. A plurality of reinforcing ribs 75 is erected between the sheet guide part 71 and the attachment part 76.

Especially in this embodiment, the attachment part 76 of the sheet transport guide 70 has a plate-like part that is extended in parallel with the top board frame 61 and also extended toward the top board frame 61 (in the Y1 direction in FIG. 5). With this configuration, when the sheet transport guide 70 is fixed to the top board frame 61 via the attachment part 76, the bottom surface of the attachment part 76 and the top surface of the top board frame 61 come close to each other and thus are connected to each other (see FIG. 2).

As shown in FIG. 6, the cover member 50 is provided outside of the fixing frame 60 to which the sheet transport guide 70 is attached. The cover member 50 has heat insulating property, and is detachably engaged with the fixing frame 60 so as to be outside of the fixing frame 60. In this embodiment, the cover member 50 includes: a first cover member 51 that is disposed above the top board frame 61 of the fixing frame 60 so as to cover the space on the upper side Z1 of the top board frame 61; and a second cover member 52 that is disposed on the opposite side of the first cover member 51 so as to cover the space on the lower side Z2 of the fixing frame 60.

The cover member 50 is provided with a plurality of heat retention spaces partitioned from one another. In the heating device 10 according to this embodiment, a plurality of partitioned heat retention spaces is disposed inside of the first cover member 51 so as to open toward the top board frame 61 of the fixing frame 60.

In the inside of the first cover member 51 shown in FIG. 7, first spaces S1 and a second space S2 are formed, each of which is partitioned by a plurality of wall parts. As described in detail later, the first spaces S1 are heat retention spaces each disposed above the corresponding support part 432 in the state in which the first cover member 51 is attached to the top board frame 61. The second space S2 is a heat retention space disposed above the top board frame 61. The first spaces S1 and the second space S2 are disposed in the first cover member 51 so as not to communicate with each other but to separate from each other.

The first cover member 51 has a heat source end facing wall 512 and a first closing wall 513 as the wall parts constituting each first space S1. The heat source end facing wall 512 is provided at a position corresponding to each of the end parts of the support parts 432 at both end parts of the lamp heater 43 so as to be extended in the direction along the respective side parts (the front frame 62 and the rear frame 63) (here, in the lower side Z2 direction). The first closing wall 513 is provided so as to be connected to the heat source end facing wall 512, and to be extended having a substantially square U-shape to surround the space above the support part 432.

The heat source end facing wall 512 and the first closing wall 513 are suspended downward from the inside of the first cover member 51. In this case, they are extended toward the top surface of the top board frame 61. Thus, the first space S1 is formed as a space that is closed in the axial direction X and the horizontal direction Y, and that is opened toward the top board frame 61 in the vertical direction Z.

Figure 8:
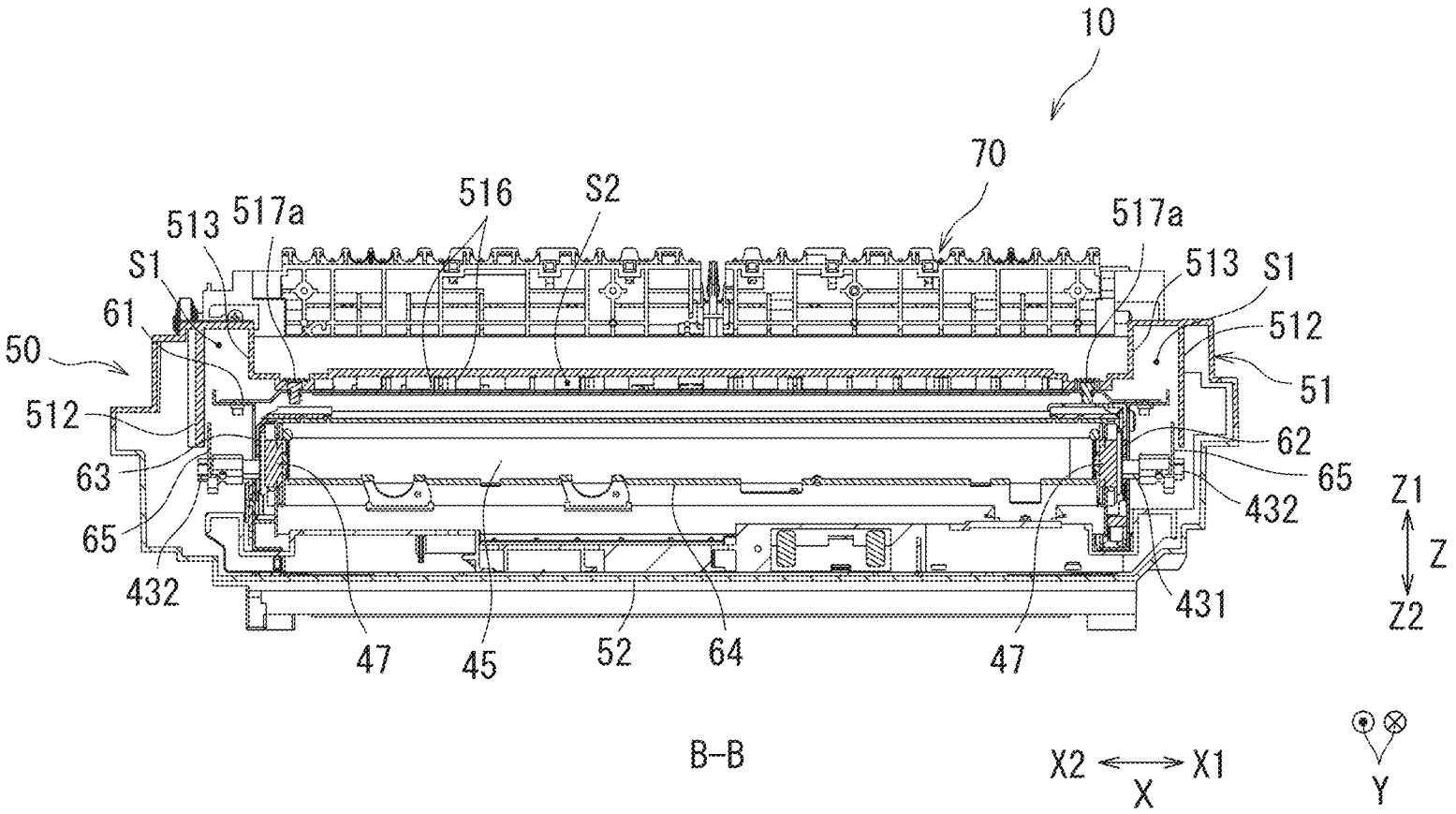
FIG. 8 is a cross-sectional view taken along the line B-B of FIG. 2, which illustrates the sheet heating device.
Figure 9:
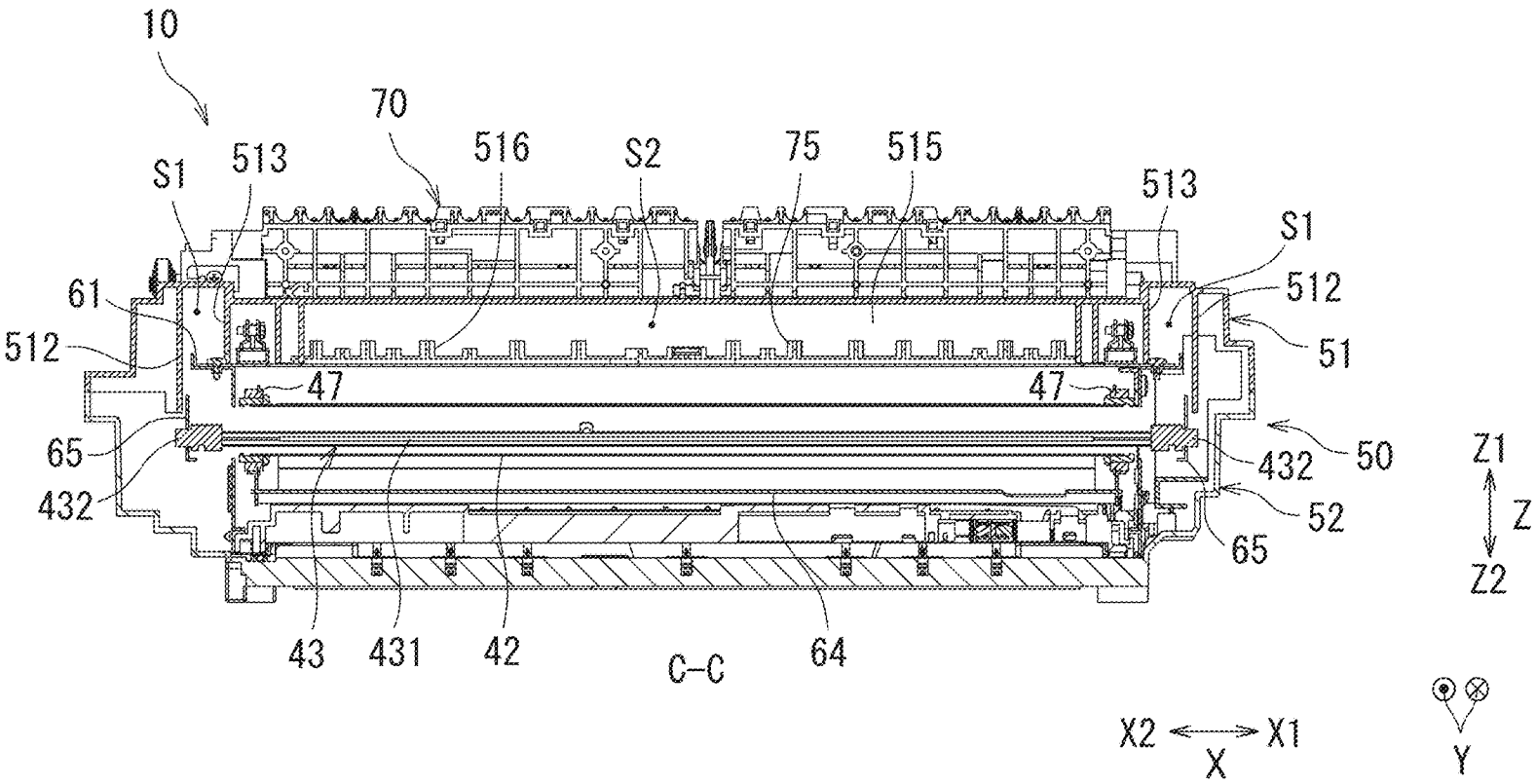
FIG. 9 is a cross-sectional view taken along the line C-C of FIG. 2, which illustrates the sheet heating device.
Figure 10:
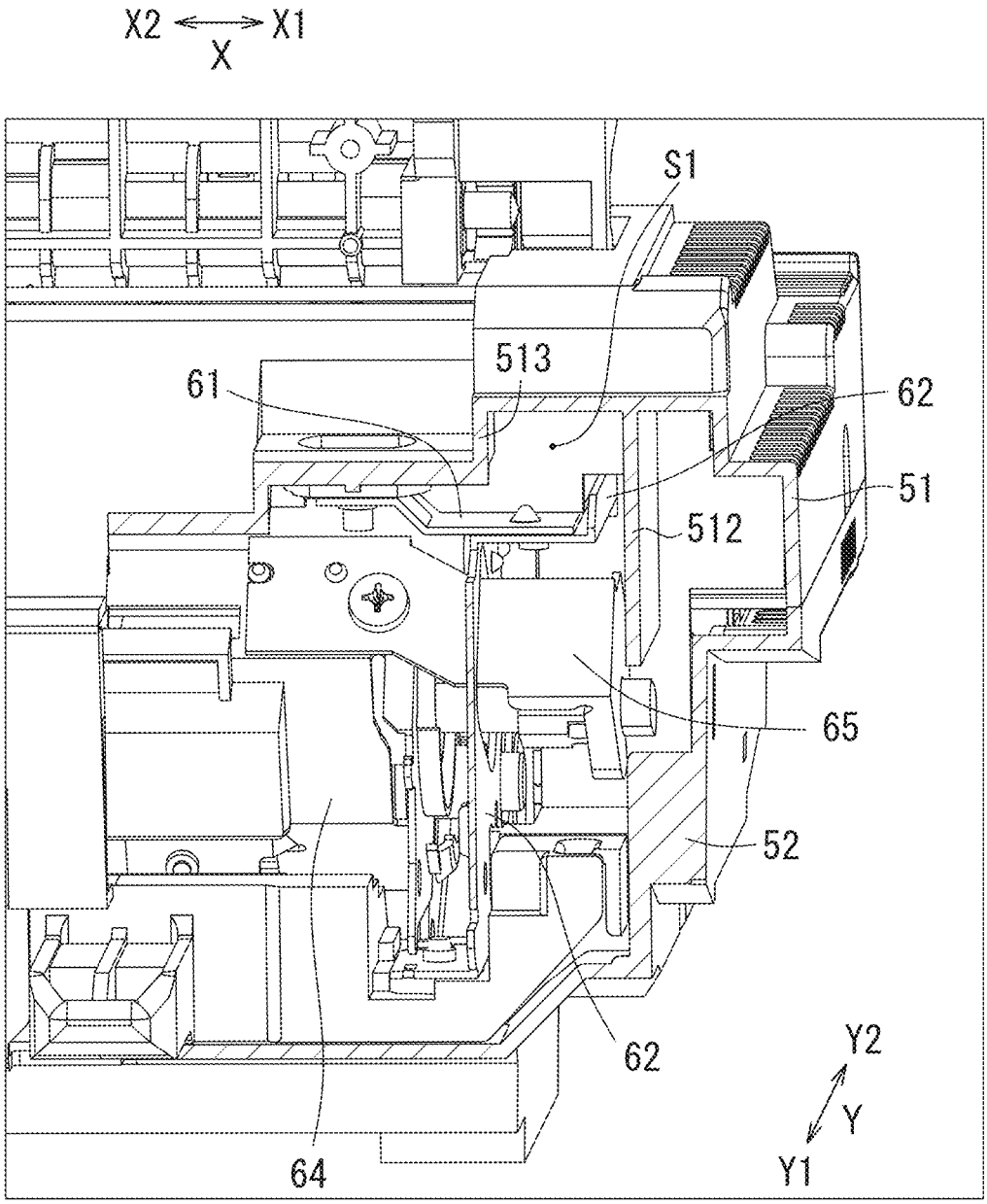
FIG. 10 is a perspective view illustrating an internal structure by partially cutting away the cover member.

FIG. 8 is a cross-sectional view taken along the line B-B of FIG. 2, and FIG. 9 is a cross-sectional view taken along the line C-C of FIG. 2. FIG. 10 is a perspective view illustrating an internal structure by partially cutting away the cover member 50.

As shown in FIGS. 8 to 10, the heat source end facing wall 512 is disposed on the opposite side of the heat generating part 431 at the lamp holder 65 so as to face the lamp holder 65. The heat generating part 431 of the lamp heater 43 is provided inside of the lamp holder 65, and the end part of the support part 432 of the lamp heater 43 is provided so as to protrude to the outside of the lamp holder 65. When the first cover member 51 is attached to cover the space above the fixing frame 60, the heat source end facing wall 512 of the first cover member 51 comes close to the lamp holder 65, and is disposed such that the lower end part of the heat source end facing wall 512 is positioned outside of the lamp holder 65.

In this way, the first space S1 surrounded by the heat source end facing wall 512 and the first closing wall 513 is formed above the support part 432 of the lamp heater 43. As shown in FIGS. 9 and 10, although the lower end part of the first closing wall 513 comes into contact with the top surface of the top board frame 61, the heat source end facing wall 512 and the top board frame 61 do not come into contact with each other. A gap exists therebetween. The air heated by thermal radiation from the heat generating part 431 of the lamp heater 43 flows upward from each end part of the lamp heater 43 through the space partitioned by the lamp holder 65 and the heat source end facing wall 512, and flows into the first space S1 via the gap between the top board frame 61 and the heat source end facing wall 512. Thus, the air heated by thermal radiation from the heat generating part 431 can be stored in both end parts of the lamp holders 65 as well as in the first spaces S1 with the air heat being kept.

Also as shown in FIG. 7, the first cover member 51 includes, as walls constituting the second space S2: a plurality of second closing walls 515 extending in the longitudinal direction of the heat roller 42 (i.e. in the axial direction X); and side wall parts 514 connecting both end parts, in the longitudinal direction, of the respective second closing walls 515.

In this embodiment, three second closing walls 515 are disposed inside of the first cover member 51 so as to be in parallel with one another. Each of the second closing walls 515 is extended toward the top surface of the top board frame 61, and the lower end part (edge part) thereof is extended to the position facing the top board frame 61. The second spaces S2 each surrounded by two second closing walls 515 and the side wall parts 514 are formed so as to have an elongated shape in the axial direction X. Thus, two second spaces S2 are aligned in parallel with each other in the first cover member 51.

The second closing wall 515 is provided with a plurality of recessed cutout parts 516 that is opened toward the top board frame 61. At the cutout parts 516 of the second closing wall 515, the gap between each cutout part 516 and the top board frame 61 is large. Thus, as shown in FIG. 9, since the second closing wall 515 has the plurality of cutout parts 516, the distance from the second closing wall 515 to the top board frame 61 changes depending on whether it is the distance from the cutout part 516 or the distance from another part not having the cutout part 516. Therefore, it is possible to prevent second closing wall 515 from warping by heat. That is, the cutout parts 516 absorb deformation of the second closing wall 515 caused by thermal expansion (i.e. deformation expanding in the axial direction X), which leads to reduction in the amount of deformation.

Also, into the cutout parts 516, the reinforcing ribs 75 of the sheet transport guide 70 are respectively inserted. The second space S2 formed by the second closing walls 515 and the side wall parts 514 does not communicate with the first space S1, but is provided individually. The second space S2 is formed as a space that is closed in the axial direction X and the horizontal direction Y, and that is opened toward the top board frame 61 in the vertical direction Z.

Figure 11:
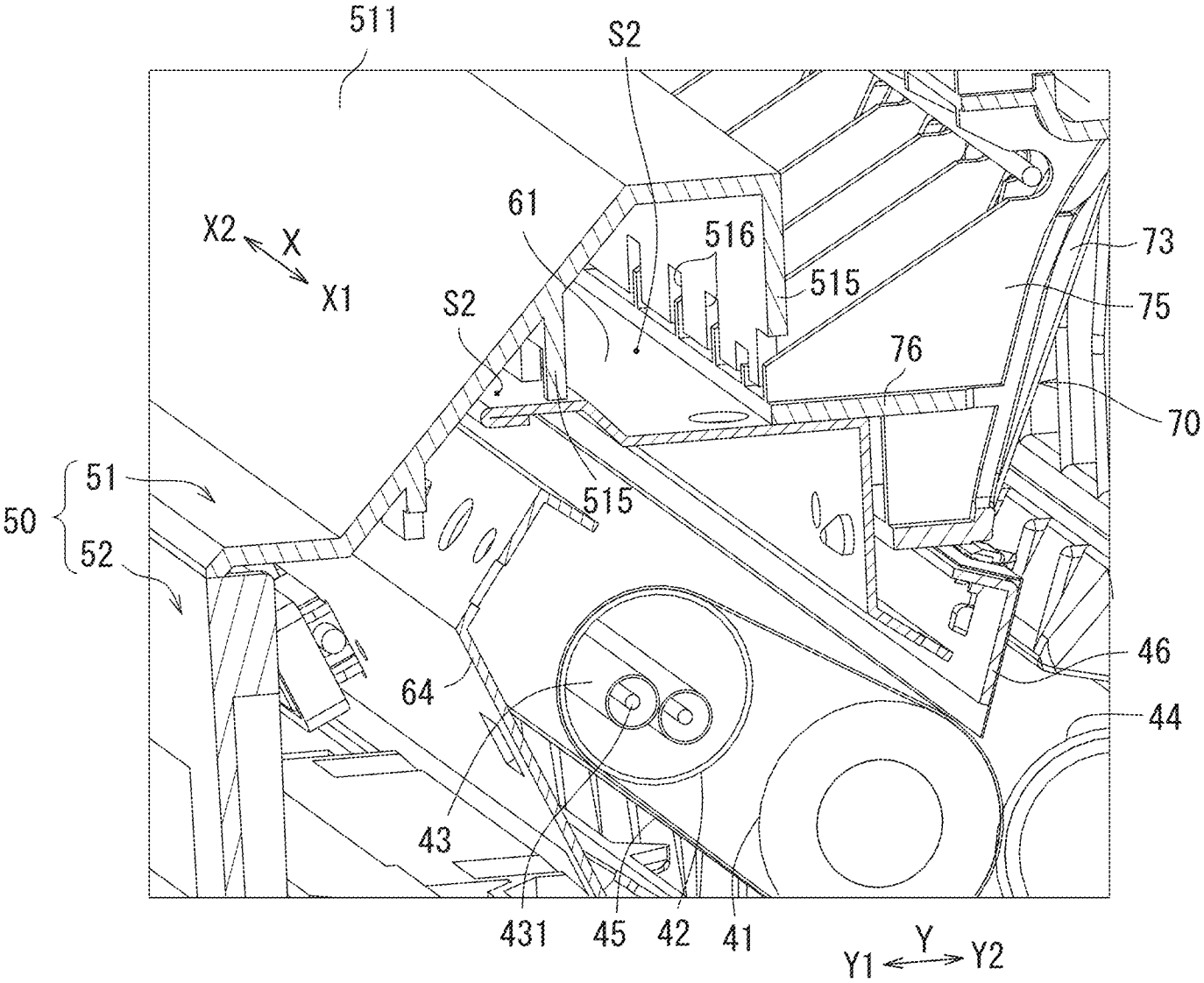
FIG. 11 is a perspective view illustrating an internal structure by partially cutting away the fixing frame and the cover member.

FIG. 11 is a perspective view illustrating an internal structure by partially cutting away the cover member 50 and the fixing frame 60. As shown in FIG. 11, the attachment part 76 of the sheet transport guide 70 is disposed to be connected to the top surface of the top board frame 61. The second space S2 is formed above the top board frame 61 that is provided with the attachment part 76. The second space S2 is provided so as to include the space above the top board frame 61 and to have an elongated shape in the axial direction X. Almost all the space above the top board frame 61 is thus covered by the first cover member 51, and here two second spaces S2 are formed.

With this configuration, the second spaces S2 surrounded respectively by the top board frame 61, the second closing walls 515 and the side wall parts 514 are formed above the heat generating part 431 of the lamp heater 43. The air heated by thermal radiation from the heat generating part 431 of the lamp heater 43 is conducted via the top board frame 61, and stored in the second spaces S2 with the air heat being kept. Since the second spaces S2 are widely formed above the top board frame 61, the heat retaining effect can be improved.

Also as shown in FIG. 11, the first cover member 51 includes an inclined part 511. The inclined part 511 is formed so as to cover the two second spaces S2 aligned in the horizontal direction Y, and to incline as a descending slope from the right side Y2 to the left side Y1. Furthermore, the inclined part 511 is an external surface of the first cover member 51 above the heat roller 42. By having the inclined part 511 as described above, the first cover member 51 forms upward airflow outside of the first cover member 51 as shown in FIG. 2, which can prevent the outer periphery of the heat roller 42 from being cooled excessively.

Figure 12:
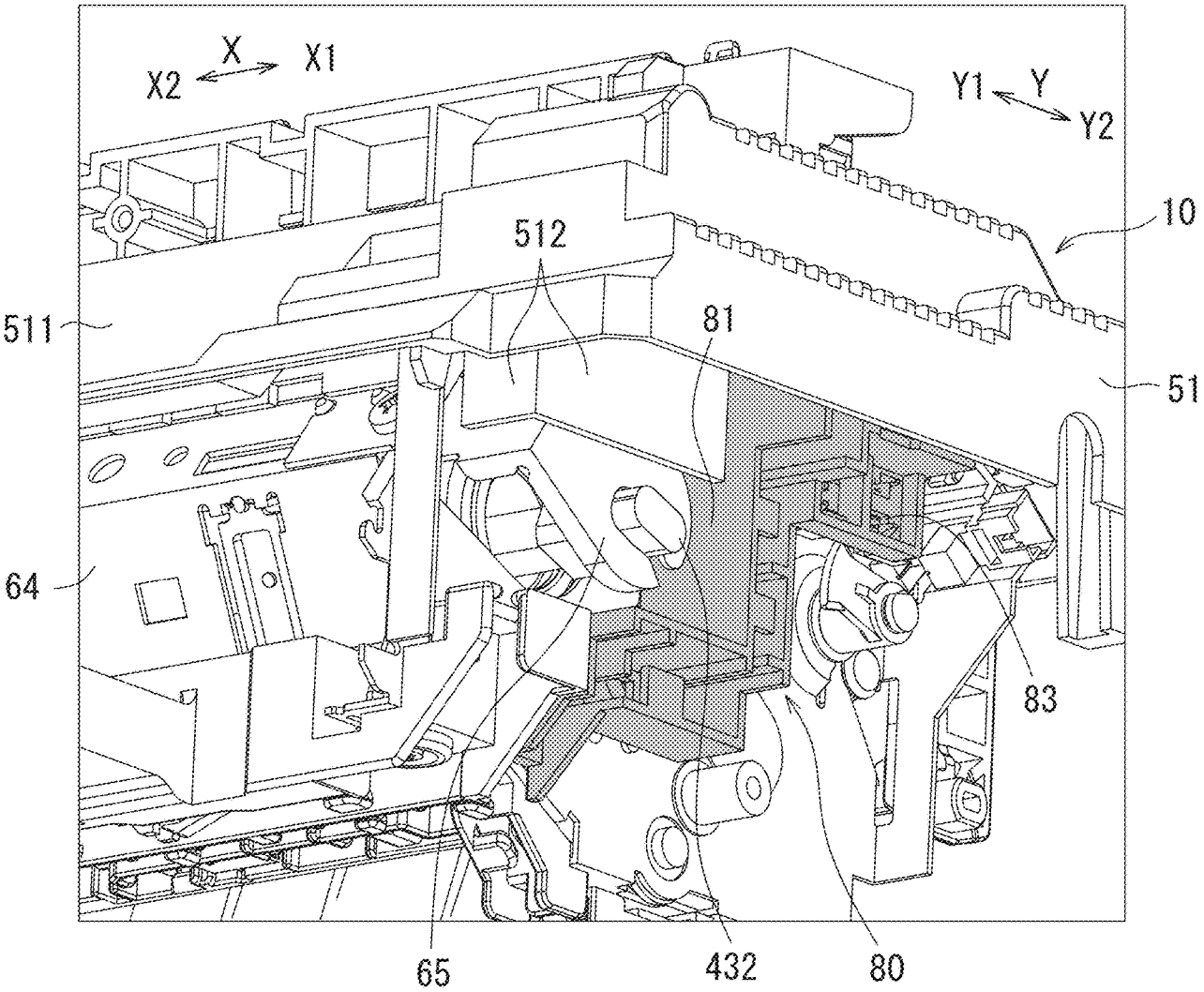
FIG. 12 is a perspective view illustrating a partition member provided inside of the cover member.
Figure 13:
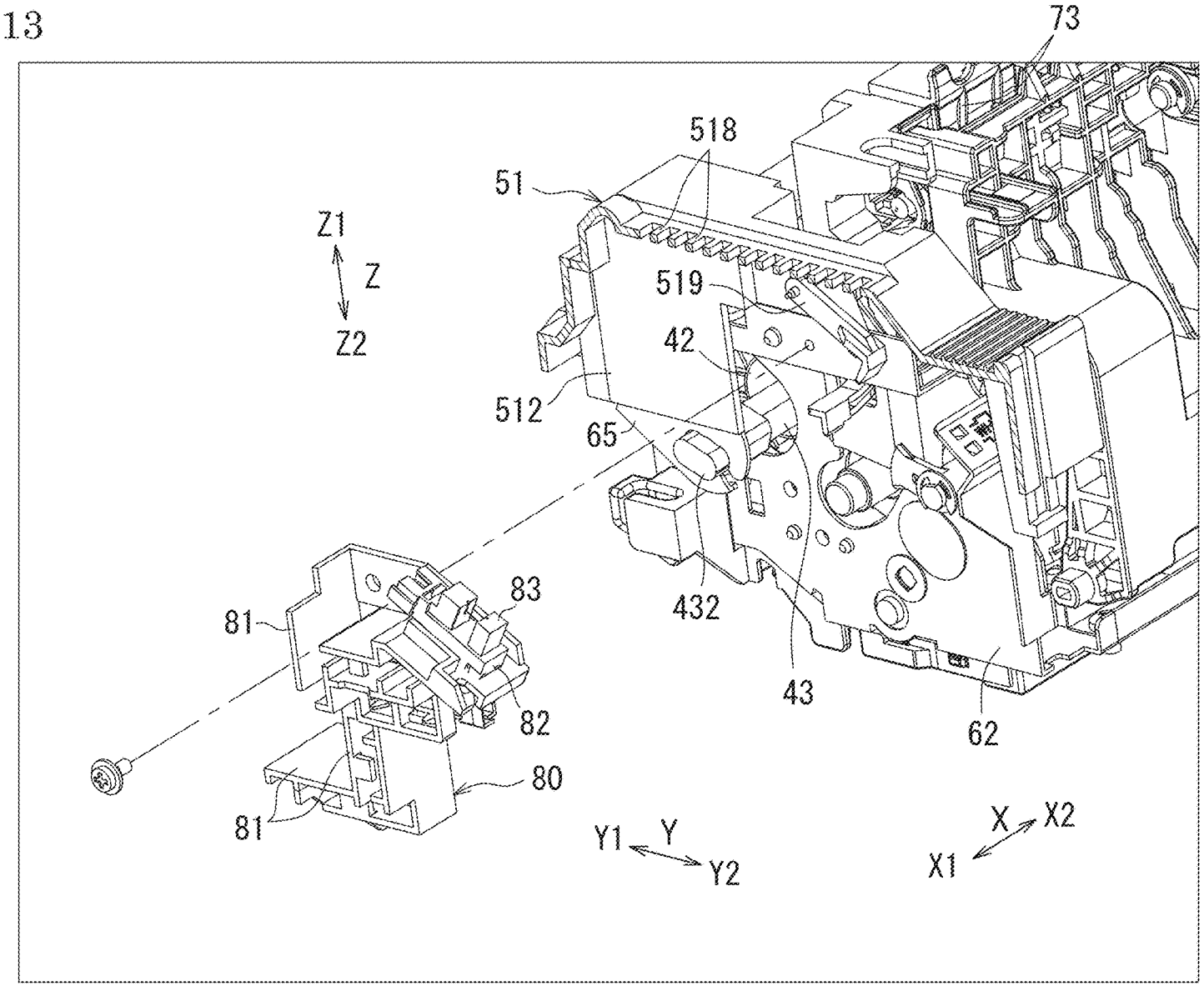
FIG. 13 is an explanatory diagram indicating an attaching structure of the partition member.
Figure 14:
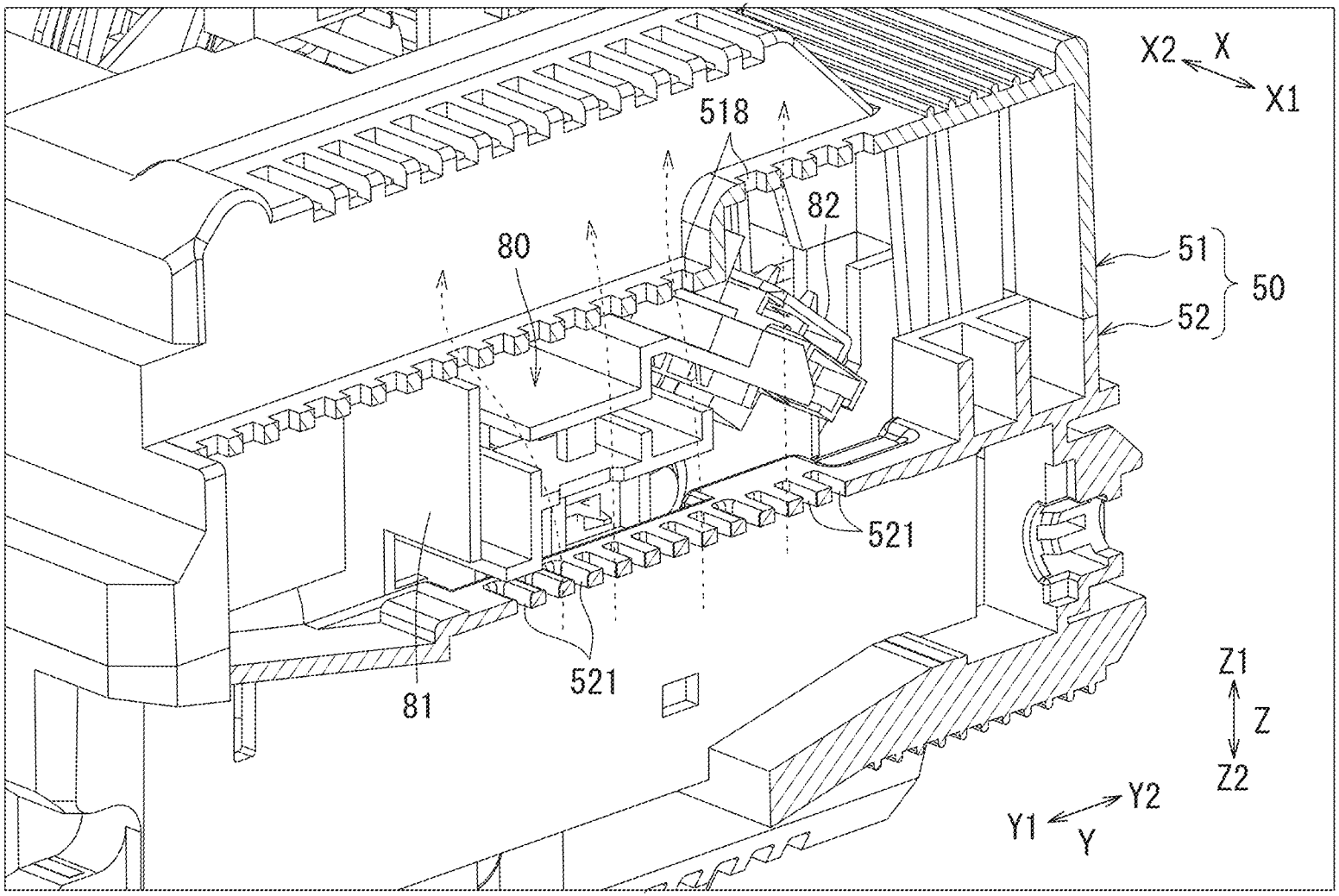
FIG. 14 is a perspective view illustrating airflow on the outside of the partition member.

FIG. 12 is a perspective view illustrating a partition member 80 provided inside of the cover member 50. FIG. 13 is an explanatory diagram indicating an attaching structure of the partition member 80. FIG. 14 is a perspective view illustrating airflow on the outside of the partition member 80. In FIG. 12, the sheet heating device 10 is viewed from diagonally below in the state in which the second cover member 52 is removed. Also, the partition member 80 is indicated in gray color in order to easily distinguish it from the other components.

As shown in FIG. 13, the partition member 80 is detachably attached to the front frame 62 of the fixing frame 60. Also, the partition member 80 is provided facing the front frame 62 to cover the external surface of the front frame 62. In this embodiment, the partition member 80 includes: a plurality of partition wall parts 81 partitioning the space surrounded by the front frame 62, the first cover member 51 and the second cover member 52; and a sensor attachment part 82 disposed in an inclined manner on the upper side Z1 of the partition wall part 81.

The partition wall parts 81 each have a length to be housed between the front frame 62 and the cover member 50 in the axial direction X. The partition wall parts 81 have multiple kinds of embodiments including the parts disposed in the horizontal direction Y and the parts disposed in the vertical direction Z. The sensor attachment part 82 is provided with a sensor 83 that detects skewing of the fixing belt 45. The front frame 62 is provided with a detection lever 519 that faces the sensor 83, and thus, when the partition wall parts 81 are attached to the front frame 62, the sensor 83 can detect skewing.

By providing the above-described partition wall parts 81 at the end part of the heat roller 42, it is possible to partition the space surrounded by the front frame 62, the first cover member 51 and the second cover member 52. In this way, the heat of the lamp heater 43 can be kept on the side of the front frame 62 so as to reduce outflow of the heat to the outside of the partition member 80 (i.e. on the side of the cover member 50). Also, since the heat-sensitive sensor 83 is disposed further on the side of the first cover member 51 with respect to the interposed partition member 80, it is possible to block the heat flow that may easily affect the sensor 83.

Also as shown in FIG. 14, the first cover member 51 and the second cover member 52 respectively include a plurality of communication holes 518 and a plurality of communication holes 521 that communicate with the sensor attachment part 82 partitioned by the partition wall parts 81. By vertically disposing the respective communication holes 518 and the respective communication holes 521, the airflow is formed, which passes from the lower side Z2 to the upper side Z1 through the communication holes 518 and 521. Thus, it is possible to cool the heat-sensitive sensor 83, and to prevent the sensor attachment part 82 from having a high temperature.

With the sheet heating device 10 having the above-described configuration, it is possible to retain the heat in the first spaces S1 and the second spaces S2 formed above the lamp heater 43 provided in the heat roller 42, and accordingly it is possible to prevent the heat outflow to the outside of the device as well as to prevent the heat loss in the device.

As shown in FIGS. 8 and 9, since the first spaces S1 are disposed above the respective support parts 432, it is possible to store the air heated by the lamp heater 43 provided in the heat roller 42 in the vicinities of the respective end parts of the lamp heater 43. Furthermore, since the first spaces S1 are provided separately from the second spaces S2, the heat is hardly lost. Accordingly, it is possible to efficiently retain the heat in the spaces corresponding to the end parts of the lamp heater 43. Especially, the end parts of the lamp heater 43 easily serve as paths through which the heat is lost. Thus, by retaining the heat in the first spaces S1, it is possible to make the vicinities of the respective end parts of the lamp heater 43 hardly cool down. Even when the image forming apparatus 1 intermittently performs image forming processing, it is possible to decrease the warm-up time and also to reduce power consumption for re-heating, because the heat outflow is prevented.

Also, since the second spaces S2 are disposed above the heat generating part 431 of the lamp heater 43, it is possible to reduce heat dissipation from the heat roller 42 and thus to obtain high heat retaining effect, which contributes to reduction in power consumption for re-heating. Therefore, by including the sheet heating device 10, the image forming apparatus 1 can provide further improved energy serving performance.

In addition to the above, the first spaces S1 and the second spaces S2 can be formed by simply attaching the first cover member 51 to the fixing frame 60. Thus, it is not necessary to separately install a component to cover the circumference of the heat source in contrast to the conventional structure of the device. Thus, it is possible to reduce the total number of the components required to form the image forming apparatus 1. Since the first cover member 51 is easily attached to and removed from the sheet heating device 10, it is possible to perform replacement work of the components such as lamp heater 43 immediately after removing the first cover member 51, which results in high maintainability.

The image forming apparatus 1 including the sheet heating device 10 of the present invention is not limited to the multifunction peripheral as shown in FIG. 1. The present invention can be applied to other types of image forming apparatuses such as a color printer, a monochrome multifunction peripheral, a monochrome printer, and a color multifunction peripheral or color printer with an image forming unit by the inkjet recording method.

The present invention may be embodied in other forms without departing from the gist or essential characteristics thereof. The foregoing embodiment is therefore to be considered in all respects as illustrative and not limiting. The scope of the invention is indicated by the appended claims rather than by the foregoing description, and all modifications and changes that come within the meaning and range of equivalency of the claims are intended to be embraced therein.

What is claimed is:

1. A sheet heating device comprising:

a heat source including a heat generating part;

a heating member provided with the heat generating part disposed inside thereof;

a frame including side parts disposed so as to face each other and a connecting part connecting the side parts, the frame supporting the heating member and the heat source; and a cover member engaged with the frame and provided outside of the frame, wherein the cover member includes: a first cover member to cover a space on an upper side of the frame; and a second cover member to cover a space on a lower side of the frame, and a plurality of heat retention spaces is provided inside of the first cover member so as to be partitioned from one another and to be opened toward the connecting part.

2. The sheet heating device according to claim 1, wherein the plurality of heat retention spaces includes: two first spaces; and at least one second space provided between the two first spaces.

3. The sheet heating device according to claim 2, wherein the two first spaces and the at least one second space are separated from one another.

4. The sheet heating device according to claim 2, wherein the heat source includes support parts respectively provided at both end parts of the heat generating part, the cover member includes heat source end facing walls and first closing walls so as to form the two first spaces, each of the heat source end facing walls is provided at a position corresponding to the corresponding one of the end parts of the support parts so as to be extended in a direction along the corresponding one of the side parts, and each of the first closing walls is provided so as to be connected to the corresponding one of the heat source end facing walls, and is extended so as to surround a space above the corresponding one of the support parts.

5. The sheet heating device according to claim 4, wherein the frame includes heat source holders respectively supporting the support parts, and each of the heat source end facing walls is disposed on an opposite side of the heat generating part at the corresponding one of the heat source holders so as to face the corresponding one of the heat source holders.

6. The sheet heating device according to claim 2, wherein the cover member includes: second closing walls extending in a longitudinal direction of the heating member; and side wall parts connecting both end parts of the respective second closing walls, and an edge part, which is on a side of the connecting part, of each of the second closing walls is extended to a position facing the connecting part.

7. The sheet heating device according to claim 6, wherein each of the second closing walls includes a plurality of cutout parts that is opened toward the connecting part.

8. The sheet heating device according to claim 6, wherein a sheet transport guide, which guides a sheet in a transport direction, is attached to the connecting part, and the at least one second space is provided along the longitudinal direction, and includes a space above an attachment part of the sheet transport guide to the connecting part.

9. The sheet heating device according to claim 8, wherein the at least one second space includes a plurality of second spaces, the plurality of second spaces is aligned in the longitudinal direction so as to be in parallel with one another, the cover member includes an inclined part that forms a part of an external surface of the cover member, and the inclined part is disposed in an inclined manner so as to cover the plurality of second spaces.

10. The sheet heating device according to claim 9 further comprising a partition member detachably attached to at least one of the side parts, wherein the partition member includes: partition wall parts partitioning a space surrounded by the at least one side parts, the first cover member and the second cover member; and a sensor attachment part positioned on an opposite side of the partition wall parts.

11. The sheet heating device according to claim 10, wherein the first cover member and the second cover member respectively include a plurality of communication holes that communicates with the sensor attachment part.

12. An image forming apparatus comprising the sheet heating device according to claim 1.

13. A sheet heating device comprising:

a heat source including a heat generating part;

a heating member provided with the heat generating part disposed inside thereof;

a frame including side parts disposed so as to face each other and a connecting part connecting the side parts, the frame supporting the heating member and the heat source; and a cover member engaged with the frame and provided outside of the frame, wherein the connecting part includes an engagement surface extending in a longitudinal direction along the heating member, a plurality of ribs is erected inside of the cover member so as to extend in a direction orthogonally intersecting with the longitudinal direction, and an end part of each of the plurality of ribs comes into contact with the engagement surface so as to form a plurality of heat retention spaces inside the cover member that is partitioned by the plurality of ribs and the engagement surface.

14. An image forming apparatus comprising the sheet heating device according to claim 13.

* * * * *